US007102604B2

(12) United States Patent
Hong

(10) Patent No.: US 7,102,604 B2
(45) Date of Patent: Sep. 5, 2006

(54) LIQUID CRYSTAL DISPLAY HAVING COMMON VOLTAGES

(75) Inventor: Yun-Teak Hong, Seoul (KR)

(73) Assignee: Samsung Electronics Co. Ltd., Kyungki-do (KR)

( * ) Notice: Subject to any disclaimer, the term of this patent is extended or adjusted under 35 U.S.C. 154(b) by 389 days.

(21) Appl. No.: 10/637,480

(22) Filed: Aug. 8, 2003

(65) Prior Publication Data

US 2004/0169627 A1 Sep. 2, 2004

(30) Foreign Application Priority Data

Dec. 17, 2002 (KR) ..... 10-2002-0080817

(51) Int. Cl.
*G09G 3/36* (2006.01)

(52) U.S. Cl. ..... 345/87; 345/89

(58) Field of Classification Search ..... 345/87, 345/88, 89, 90–95, 96–100, 103, 204, 208, 345/209, 210, 101
See application file for complete search history.

(56) References Cited

U.S. PATENT DOCUMENTS 6,118,421 A * 9/2000 Kawaguchi et al. ..... 345/89
6,166,714 A * 12/2000 Kishimoto ..... 345/96
6,466,191 B1 * 10/2002 Choi et al. ..... 345/94
6,853,406 B1 * 2/2005 Lee et al. ..... 349/43

* cited by examiner

*Primary Examiner*—Bipin Shalwala
*Assistant Examiner*—Nitin Patel
(74) *Attorney, Agent, or Firm*—Don C. Lawrence; MacPherson Kwok Chen & Heid

(57) ABSTRACT

A liquid crystal display including a plurality of pixels arranged in a matrix includes a variable common voltage generator. The variable common voltage generator includes a frame memory storing image data for one frame, an average gray calculator calculating the average gray of the image data for one frame, a comparator comparing the calculated average gray from the average gray calculator with a reference gray and generating an adjusting value based on the compared result, and a D/A converter selecting a voltage having an appropriate value among a plurality of voltages generated based on the adjusting value from the comparator and applying the selected voltage as a common voltage.

9 Claims, 4 Drawing Sheets

LIQUID CRYSTAL DISPLAY HAVING COMMON VOLTAGES

BACKGROUND OF THE INVENTION (a) Field of the Invention

The present invention relates to a liquid crystal display having a plurality of common voltages.

(b) Description of the Related Art

Liquid crystal displays (LCDs) include two panels having pixel electrodes and a common electrode and a liquid crystal (LC) layer with dielectric anisotropy, which is interposed between the two panels. The pixel electrodes are arranged in a matrix and connected to switching elements such as thin film transistors (TFTs). The switching elements selectively transmit data voltages from data lines in response to gate signals from gate lines. The common electrode covers entire surface of one of the two panels and is supplied with a common voltage. The pixel electrode, the common electrode, and the LC layer form a LC capacitor in circuital view, which is a basic element of a pixel along with the switching element connected thereto.

In the LCD, voltages are applied to the two electrodes to generate electric field in the LC layer, and the transmittance of light passing through the LC layer is adjusted by controlling the strength of the electric field, thereby obtaining desired images. In order to prevent image deterioration due to long-time application of the unidirectional electric field, polarity of data voltages with respect to the common voltage is reversed every frame, every row, or every dot.

However, the polarity inversion causes flicker phenomenon. The flicker phenomenon is due to a kickback voltage, which is generated due to the characteristic of the switching element. That is, a pixel voltage across the LC capacitor is decreased by an amount of the kickback voltage, thereby generating the flicker phenomenon.

The kickback voltage varies depending on the position on an LCD panel. In particular, the variation of the kickback voltage is large along a row direction, i.e., the extending direction of the gate lines. It is because the difference between a gate-on voltage and a gate-off voltage, which determines the value of the kickback voltage, changes along the gate line due to the delay of the gate signals. In more detail, the kickback voltage is the largest at a position where the gate signals are first applied. However, since the drop of the gate-on voltage becomes larger as it goes away from the application point along the gate lines, the kickback voltage is decreased.

Therefore, it is suggested that a plurality of common voltages with different values should be supplied to different positions on an LCD panel to compensate the delay of the gate signals.

For example, to compensate the variation of the kickback voltage along the gate line, the common voltages having different magnitudes are applied to the left and right ends of the common electrode provided on the LCD panel.

Meanwhile, because a LC material has dielectric anisotropy, the dielectric constant of the LC material varies depending on the direction. The LC director of the LC layer in the LC capacitor is changed depending on the strength of the electric field, which in turn changes the dielectric constant of the LC layer. The change of the dielectric constant makes the capacitance of the LC capacitor be changed. Since the value of the kickback voltage depends on the capacitance of the LC capacitor, it is changed depending on the capacitance change of the LC capacitor. Generally, the variation of the kickback voltage for a data voltage applied to a pixel electrode is equal to or larger than about 17%.

However, the conventional technology applies the common voltages depending on the position on the LC panel assembly without considering the independency of the kickback voltage on the data voltages, which does not remove the flicker phenomenon.

SUMMARY OF THE INVENTION

A liquid crystal display including a plurality of pixels arranged in a matrix is provided, which includes: a gray voltage generator generating a plurality of gray voltages; a data driver applying data voltages selected from the gray voltages corresponding to image data to the pixels; a signal controller providing the image data for the data driver and generating control signals for controlling the image data, the control signals being applied to the data driver; and a common voltage generator generating at least one common voltage based on an average gray of the image data and applying the generated at least one common voltage to the pixels.

Preferably, the at least one common voltage becomes as smaller as the magnitude of the average gray become larger.

The average gray may be the image data averaged over one frame.

Preferably, a variation of the at least one common voltage is in proportion to a variation of a kickback voltage.

The common voltage generator may include a frame memory storing the image data, an average gray calculator calculating the average gray of the image data, a comparator comparing the calculated average gray from the average gray calculator with a reference gray and selecting an adjusting value for the at least one common voltage based on the compared result, a reference voltage generator generating a reference voltage for generating the at least one common voltage, and a D/A converter generating the at least one common voltage based on the reference voltage corresponding to the adjusting value from the comparator. Also, the common voltage generator may further include a negative feedback inverting amplifier including an inverting terminal receiving a feedback voltage for the common voltage applied to the pixels via a resistor and a non-inverting terminal receiving the at least one common voltage.

The comparator may include a look-up table storing the adjusting value for the compared result.

Further, the reference voltage generator may include a plurality of resistors, and usually, the reference gray is a middle gray.

BRIEF DESCRIPTION OF THE DRAWINGS

The above and other advantages of the present invention will become more apparent by describing preferred embodiments thereof in detail with reference to the accompanying drawings in which.

DETAILED DESCRIPTION OF PREFERRED EMBODIMENTS

Figure 1:
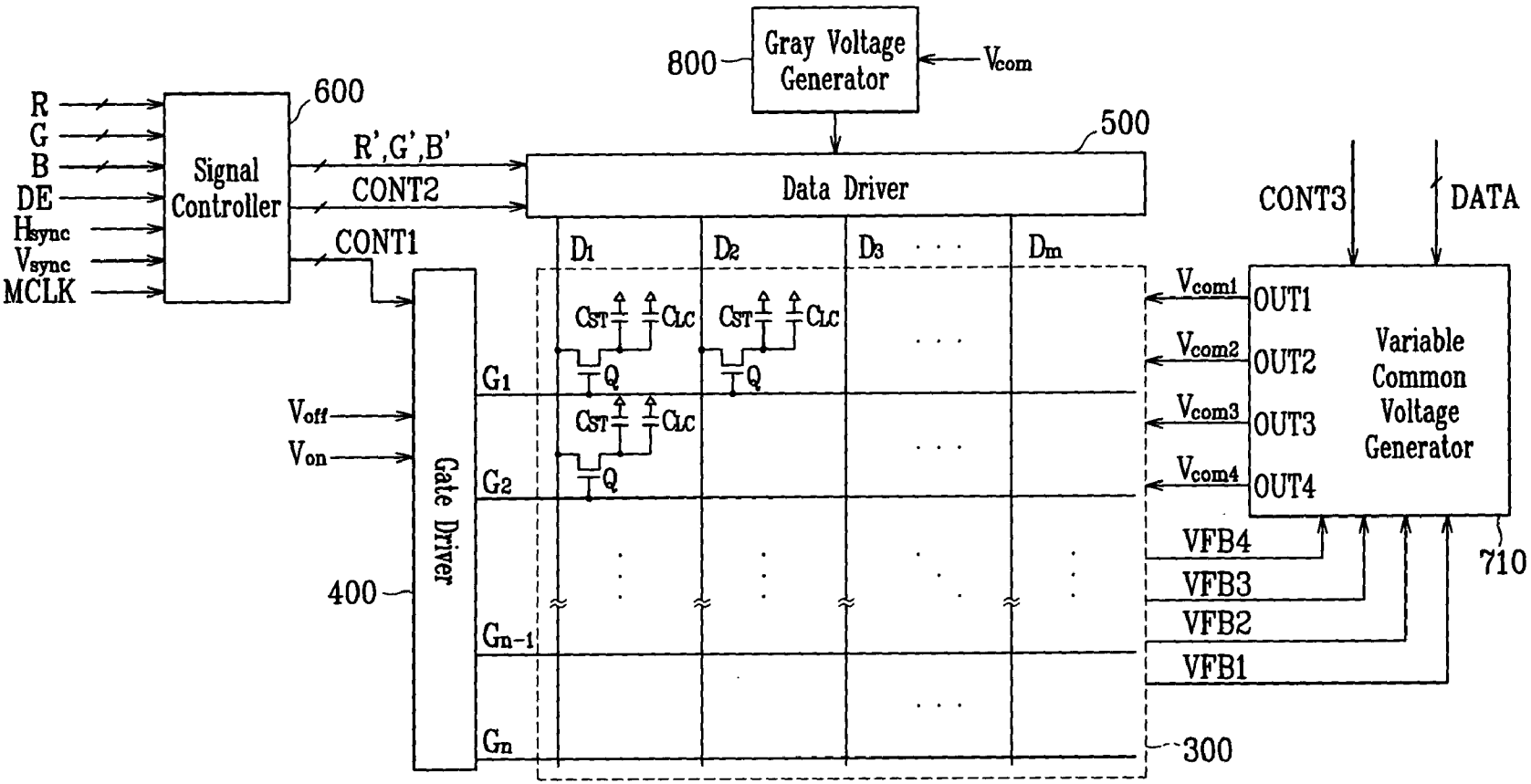
FIG. 1 is a block diagram of an LCD according to an embodiment of the present invention.

The present invention now will be described more fully hereinafter with reference to the accompanying drawings, in which preferred embodiments of the invention are shown. This invention may, however, be embodied in many different forms and should not be construed as limited to the embodiments set forth herein. Like numerals refer to like elements throughout.

In the drawings, the thickness of layers and regions are exaggerated for clarity. Like numerals refer to like elements throughout. It will be understood that when an element such as a layer, region or substrate is referred to as being "on" another element, it can be directly on the other element or intervening elements may also be present. In contrast, when an element is referred to as being "directly on" another element, there are no intervening elements present.

Then, liquid crystal displays according to embodiments of the present invention will be described with reference to the drawings.

Figure 2:
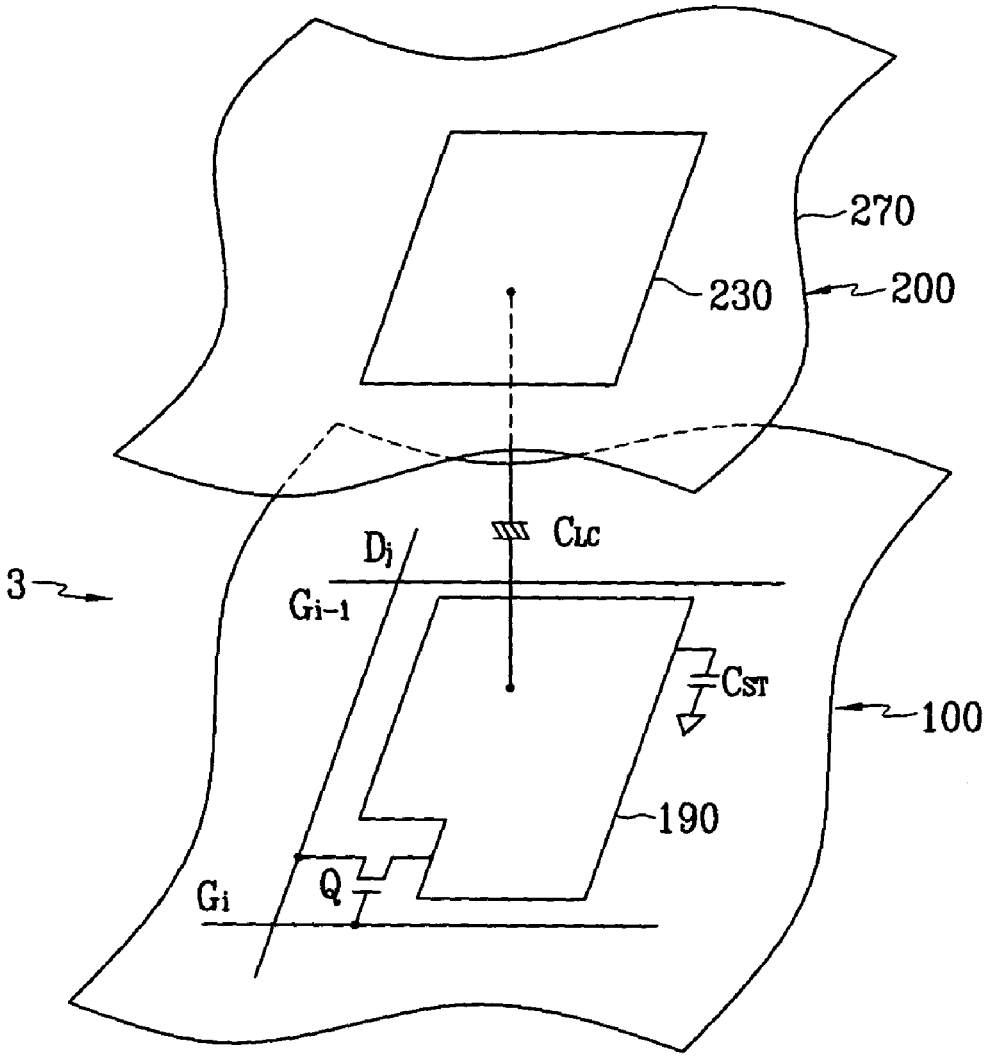
FIG. 2 is an equivalent circuit diagram of a pixel of an LCD according to an embodiment of the present invention.

FIG. 1 is a block diagram of an LCD according to an embodiment of the present invention, and FIG. 2 is an equivalent circuit diagram of a pixel of an LCD according to an embodiment of the present invention.

Referring to FIG. 1, an LCD according to an embodiment includes an LC panel assembly 300, a gate driver 400 and a data driver 500 which are connected to the panel assembly 300, a gray voltage generator 800 connected to the data driver 500, a variable common voltage generator 710 connected to the LC panel assembly 300, and a signal controller 600 controlling the above elements.

In circuital view, the LC panel assembly 300 includes a plurality of display signal lines $G_1$–$G_n$ and $D_1$–$D_m$ and a plurality of pixels connected thereto and arranged substantially in a matrix.

The display signal lines $G_1$–$G_n$ and $D_1$–$D_m$ include a plurality of gate lines $G_1$–$G_n$ transmitting gate signals (also referred to as "scanning signals"), and a plurality of data lines $D_1$–$D_m$ transmitting data signals. The gate lines $G_1$–$G_n$ extend substantially in a row direction and substantially parallel to each other, while the data lines $D_1$–$D_m$ extend substantially in a column direction and substantially parallel to each other.

Each pixel includes a switching element Q connected to the signal lines $G_1$–$G_n$ and $D_1$–$D_m$, and a LC capacitor $C_{LC}$ and a storage capacitor $C_{ST}$ that are connected to the switching element Q. If necessary, the storage capacitor $C_{ST}$ may be omitted.

The switching element Q is provided on a lower panel 100 and has three terminals, a control terminal connected to one of the gate lines $G_1$–$G_n$, an input terminal connected to one of the data lines $D_1$–$D_n$, and an output terminal connected to both the LC capacitor $C_{LC}$ and the storage capacitor $C_{ST}$.

The LC capacitor $C_{LC}$ includes a pixel electrode 190 provided on the lower panel 100 and a common electrode 270 provided on an upper panel 200 as two terminals. The LC layer 3 disposed between the two electrodes 190 and 270 functions as dielectric of the LC capacitor $C_{LC}$. The pixel electrode 190 is connected to the switching element Q and the common electrode 270 is connected to the common voltage $V_{com}$ and covers entire surface of the upper panel 200. Unlike FIG. 2, the common electrode 270 may be provided on the lower panel 100, and both electrodes 190 and 270 have shapes of bar or stripe.

The storage capacitor $C_{ST}$ is defined by the overlap of the pixel electrode 190 and a separate wire (not shown) provided on the lower panel 100 and applied with a predetermined voltage such as the common voltage $V_{com}$. Otherwise, the storage capacitor $C_{ST}$ is defined by the overlap of the pixel electrode 190 and its previous gate line $G_{i-1}$ via an insulator.

For color display, each pixel can represent its own color by providing one of a plurality of red, green and blue color filters 230 in an area corresponding to the pixel electrode 190. The color filter 230 shown in FIG. 2 is provided in the corresponding area of the upper panel 200. Alternatively, the color filters 230 are provided on or under the pixel electrode 190 on the lower panel 100.

The LC molecules in the LC capacitor $C_{LC}$ have orientations depending on the variation of electric field generated by the pixel electrode 190 and the common electrode 270, and the molecular orientations determine the polarization of light passing through the LC layer 3. A polarizer or polarizers (not shown) attached to at least one of the panels 100 and 200 convert the light polarization into the light transmittance.

Referring to FIG. 1 again, the gray voltage generator 800 generates two sets of a plurality of gray voltages related to the transmittance of the pixels. The gray voltages in one set have a positive polarity with respect to the common voltage $V_{com}$, while those in the other set have a negative polarity with respect to the common voltage $V_{com}$.

The gate driver 400 is connected to the gate lines $G_1$–$G_n$ of the LC panel assembly 300 and applies gate signals from an external device to the gate lines $G_1$–$G_n$, each gate signal being a combination of a gate-on voltage $V_{on}$ and a gate-off voltage $V_{off}$.

The data driver 500 is connected to the data lines $D_1$–$D_m$ of the LC panel assembly 300 and selects gray voltages from the gray voltage generator 800 to apply as data signals to the data lines $D_1$–$D_m$.

The variable common voltage generator 710 is connected to the common electrode 270 of the LC panel assembly 300 and generates a plurality of variable common voltages, for example, four variable common voltages $V_{com1}$–$V_{com4}$ to be applied to respective positions of the common electrode 270 provided on the LC panel assembly 300. The value of each variable common voltage $V_{com1}$–$V_{com4}$ is defined by the image signals R, G and B.

The signal controller 600 generates control signals for controlling the gate driver 400, the data driver 500, and the variable common voltage generator 710.

Then, operations of the LCD will be described with in detail.

The signal controller 600 is supplied from an external graphic controller (not shown) with RGB image signals R, G and B and input control signals controlling the display thereof, for example, a vertical synchronization signal $V_{sync}$, a horizontal synchronization signal $H_{sync}$, a main clock CLK, a data enable signal DE, etc. The signals controller 600 generates a plurality of gate control signals CONT1, a plurality of data control signals CONT2, and a common voltage control signal CONT3 and processes the image signals R, G and B for the LC panel assembly 300 on the basis of the input control signals. The signal controller 600 provides the gate control signals CONT1 for the gate driver 400, the data control signals CONT2 and the processed image signals R', G' and B' for the data driver 500, and the common voltage control signal CONT3 for the variable common voltage generator 710.

The gate control signals CONT1 include a vertical synchronization start signal STV for informing of start of a frame, a gate clock signal CPV for controlling the output time of the gate-on voltage $V_{on}$ and an output enable signal OE for defining the widths of the gate-on voltage $V_{on}$.

The data control signals CONT2 include a horizontal synchronization start signal STH for informing of start of a horizontal period, a load signal LOAD or TP for instructing to apply the appropriate data voltages to the data lines $D_1$–$D_m$, an inversion control signal RVS for reversing the polarity of the data voltages (with respect to the common voltage $V_{com}$), and a data clock signal HCLK.

The variable common voltage generator 710 is sequentially supplied with image signals R, G and B from an external device and calculates the average gray of the image signals R, G and B for one frame. Further, the variable common voltage generator 710 adjusts the values of a plurality of variable common voltages $V_{com1}$–$V_{com4}$ based on the calculated average gray and applies the adjusted variable common voltages $V_{com1}$–$V_{com4}$ to respective positions of the common electrode 270.

The gray voltage generator 800 generates two sets of a plurality of gray

The data driver 500 receives a packet of the image data R', G' and B' for a pixel row from the signal controller 600 and coverts the image data R', G' and B' into analogue data voltages selected from the gray voltages.

Responsive to the gate control signals CONT1 from the signal controller 600, the gate driver 400 applies the gate-on voltage $V_{on}$ to the gate line $G_1$–$G_n$, thereby turning on the switching elements Q connected thereto.

The data driver 500 applies the data voltages to the corresponding data lines $D_1$–$D_m$ during a turn-on time of the switching elements Q due to the application of the gate-on voltage $V_{on}$ to gate lines $G_1$–$G_n$ connected to the switching elements Q (which is called "one horizontal period" or "1H" and equals to one period of the horizontal synchronization signal $H_{sync}$, the data enable signal DE, and the data clock signal CPV). Then, the data voltages in turn are supplied to the corresponding pixels via the turned-on switching elements Q.

By repeating this procedure, all gate lines $G_1$–$G_n$ are sequentially supplied with the gate-on voltage $V_{on}$ during a frame, thereby applying the data voltages to all pixels. When the next frame starts after finishing one frame, the inversion control signal RVS applied to the data driver 500 is controlled such that the polarity of the data voltages is reversed (which is called "frame inversion"). The inversion control signal RVS may be also controlled such that the polarity of the data voltages flowing in a data line in one frame is reversed (which is called "line inversion") or the polarity of the data voltages in one packet is reversed (which is called "dot inversion").

Next, the voltage adjustment of a plurality of variable common voltages based on an average gray of one frame according to an embodiment of the present invention will be described in detail with reference to FIGS. 3 and 4.

Figure 3:
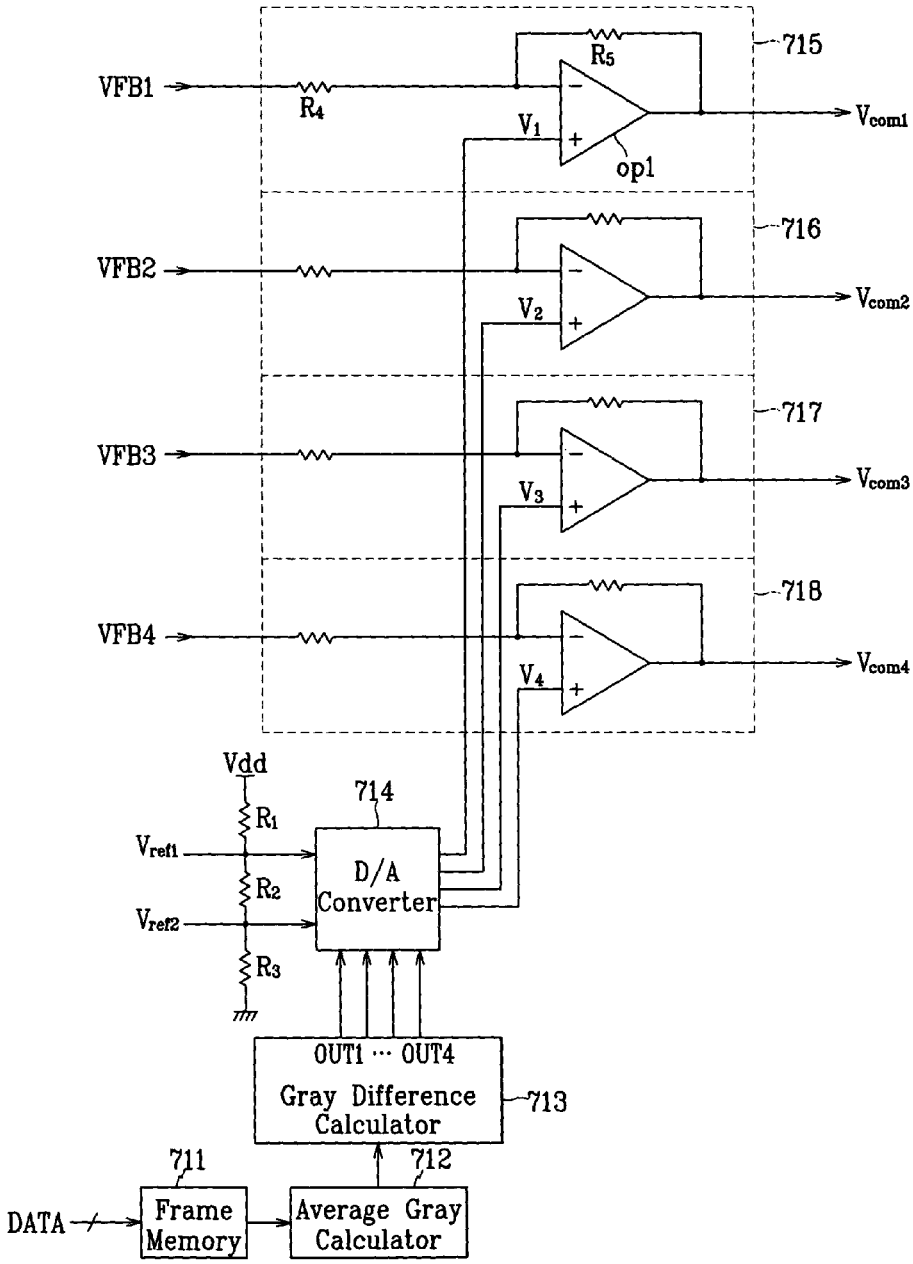
FIG. 3 is a block diagram of a variable common voltage generator according to an embodiment of the present invention.

FIG. 3 is a block diagram of an exemplary variable common voltage generator according to an embodiment of the present invention.

As shown in FIG. 3, a variable common voltage generator 710 according to this embodiment includes a frame memory 711 for storing the image signals R, G and B from an external device, an average gray calculator 712 connected to the frame memory 711, a comparator 713 connected to the average gray calculator 711, a voltage divider including three resistors $R_1$–$R_3$ connected in series between a supply voltage $V_{dd}$ and a ground voltage, a digital-analog converter (referred to as "D/A converter" hereinafter) 714 connected to the voltage divider $R_1$–$R_3$ and the comparator 713, and a plurality of, for example, four inverting amplifiers 715–718 respectively connected to the D/A converter 714.

The four inverting amplifiers 715–718 have substantially the same configuration, and for convenience, the configuration of one inverting amplifier 715 will be described in detail as an example.

The inverting amplifier 715 includes a negative feedback operating amplifier OP1 including an input resistor $R_4$ and a feedback resistor $R_5$. The inverting terminal (–) of the operating amplifier OP1 is supplied with a first feedback voltage VFB1, and the non-inverting terminal (+) thereof is connected to the D/A converter 714 such that it receives the output signal of the D/A converter 714. The operating amplifier OP1 outputs the variable common voltage $V_{com1}$ through the output terminal thereof for application to the common electrode 270.

The operation of the variable common voltage generator 710 having the above-described configuration will be described in detail.

The voltage divider $R_1$–$R_3$ divides the supply voltage $V_{dd}$ to generate divided voltages $V_{ref1}$ and $V_{ref2}$ and supplies the divided voltages $V_{ref1}$ and $V_{ref2}$ for the D/A converter 714.

The D/A converter 714 generates a plurality of voltages $V_1$–$V_4$ based on the divided voltages $V_{ref1}$ and $V_{ref2}$ to be supplied for the respective operating amplifiers 715–717. Responsive to the input voltage $V_1$ to $V_4$, each operating amplifier 715–718 generates a variable common voltage $V_{com1}$–$V_{com4}$ for application to the corresponding position of the common electrode 270. Further, each operating amplifier 715–718 is supplied with a feedback voltage VFB1–VFB4, which is fed from the corresponding position of the common electrode 270.

The value of each variable common voltage $V_{com1}$–$V_{com4}$ is determined by the resistance ratio of the input resistor $R_4$ and the feedback resistor $R_5$, and for example, the variable common voltage $V_{com1}$ is given by the relation $V_{com1}=(1+R_5/R_4)\times VFB1-(R_5/R_4)\times V_1$. Therefore, when a stable voltage is applied to the common electrode 270, $V_{com1}=V_1$. As a result, the input voltages $V_1$–$V_4$ from the D/A converter 714 can be considered to be equal to the variable common voltage $V_{com1}$–$V_{com4}$. Consequently, each operating amplifier 715–718 removes noise components such as a peak component to make the variable common voltages $V_{com1}$–$V_{com4}$ stable, thereby preventing a crosstalk of signals due to the noise components.

At this time, the values of the voltages $V_1$–$V_4$ are determined such that the flicker is the most effectively prevented for the middle gray among the total grays, for example, the 32-th gray among the total 64 grays.

Meanwhile, the common voltage generator 710 stores the input image data R, G and B into the frame memory 711. The image data R, G and B may be directly received from an external device or may be received through the signal controller 600.

When the image data R, G and B for one frame are all stored into the frame memory 711, the average gray calculator 712 calculates the average gray of the image data R, G and B for one frame and supplies the calculated average gray for the comparator 713.

Then, the comparator 713 compares the calculated average gray with a reference gray, and then supplies adjusting values, which are used to adjust the variable common voltages $V_{com1}$–$V_{com4}$ for the D/A converter 714 via corresponding output terminals OUT1–OUT4. For example, the predetermined adjusting values as function of the gray difference for the respective variable common voltages $V_{com1}$–$V_{com4}$ may be stored in an internal or external memory or look-up table. The reference gray, as described above, is usually the middle gray among the total grays. As for an example, when the total grays are 64 grays, the reference gray is the 32-th gray.

The D/A converter 714 adjusts the voltages $V_1$–$V_4$ responsive to the adjusting values from the comparator 713. The variation of the voltages $V_1$–$V_4$ depends on the characteristics of the LCD.

If it is assumed that the pixel voltage across the LC capacitor $C_{LC}$ of a pixel is $V_p$, the data voltage and the common voltage applied to the LC capacitor $C_{LC}$ are $V_d$ and $V_{com}(V_d)$, respectively, and the kickback voltage of the pixel is $V_k(V_d)$, the pixel voltage $V_p$ is determined by:

$$V_p=(V_d-V_{com})-V_k=V_d-(V_{com}+V_k). \quad (1)$$

According to an embodiment of the present invention, $V_{com}$ is decreased or increased by an amount of increase or decrease of $V_k$ such that $(V_{com}+V_k)$ for the each gray is uniform. For example, if $(V_{com}+V_k)$ is fixed to a constant C for the 32-th gray among the total 64 grays, $(V_{com}+V_k)$ satisfies the relation $V_{com}+V_k=C=V_{com}(32)+V_k(32)$.

Therefore, the difference $(\Delta V_{com})$ between the common voltage for the 32-th gray and the common voltage for the average gray is given by:

$$\Delta V_{com}=V_{com}-V_{com}(32)=V_k(32)-V_k=-\Delta V_k. \quad (2)$$

Figure 4:
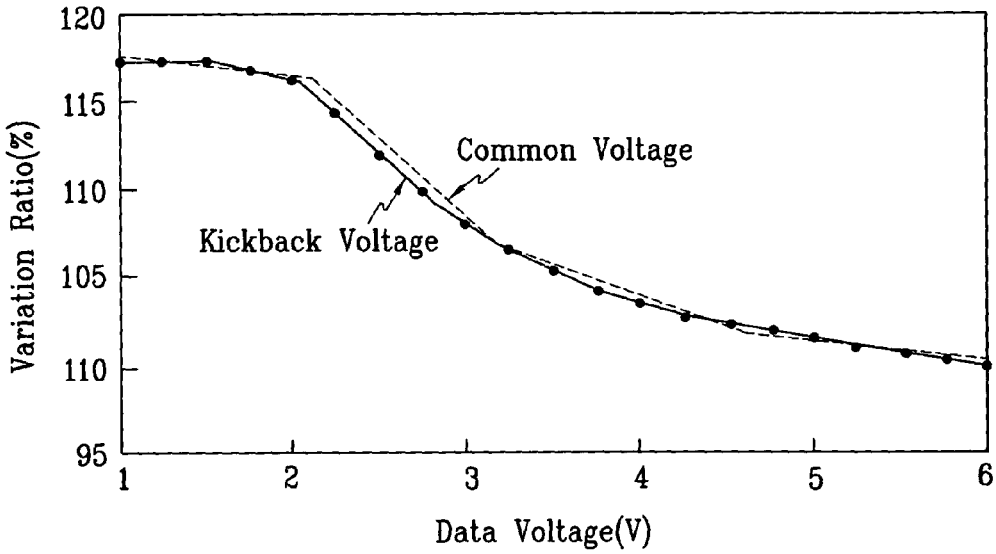
FIG. 4 is a graph showing variation ratios of a kickback voltage and a common voltage as function of a data voltage in an LCD according to an embodiment of the present invention.

The variation ratios of the kickback voltage and the common voltage as function of the data voltage are shown in FIG. 4. The curves shown in FIG. 4 indicate variation ratios of the kickback voltage and the common voltage with respect to the kickback voltage $V_k(6)$ and the common voltage $V_{com}(6)$ for the 6V data voltage, which are given by the relations:

$$\text{Variation ratio of the kickback voltage}=(1+\Delta V_k(6)/V_k(6))\times 100\%; \text{ and}$$

$$\text{Variation ratio of the common voltage}=(1-\Delta V_{com}(6)/V_{com}(6))\times 100\%, \quad (3)$$

where $\Delta V_k(6)=V_k-V_k(6)$, and $\Delta V_{com}(6)=V_{com}-V_{com}(6)$.

Referring to FIG. 4, since the variation ratio of the kickback voltage is nearly equal to the variation ratio of the common voltage, Equation 3 results in:

$$\Delta V_k(6)/V_k(6)=-\Delta V_{com}(6)/V_{com}(6). \quad (4)$$

Therefore, the common voltage may compensate the variation ratio of the kickback voltage.

According to the embodiments of the present invention, the values of the common voltages are increased or decreased based on the average gray for one frame of an LCD for compensation of the variation of the kickback voltage depending on the gray. Therefore, the variation of the pixel voltage depending on the gray is decreased to improve image quality of the LCD.

Although embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A liquid crystal display including a plurality of pixels arranged in a matrix, the display comprising:

a gray voltage generator generating a plurality of gray voltages;

a data driver applying data voltages selected from the gray voltages corresponding to image data to the pixels;

a signal controller providing the image data for the data driver and generating control signals for controlling the image data, the control signals being applied to the data driver; and, a common voltage generator generating at least one common voltage based on an average gray of the image data and applying the generated at least one common voltage to the pixels.

2. The liquid crystal display of claim 1, wherein the at least one common voltage becomes smaller as the value of the average gray become larger.

3. The liquid crystal display of claim 2, wherein the value of the average gray is the image data averaged over one frame.

4. The liquid crystal display of claim 1, wherein variation of the at least one common voltage is in proportion to variation of a kickback voltage.

5. The liquid crystal display of claim 1, wherein the common voltage generator comprises:

a frame memory storing the image data;

an average gray calculator calculating the average gray of the image data;

a comparator comparing the calculated average gray from the average gray calculator with a reference gray and selecting an adjusting value for the at least one common voltage based on the compared result;

a reference voltage generator generating a reference voltage for generating the at least one common voltage; and, a D/A converter generating the at least one common voltage based on the reference voltage corresponding to the adjusting value from the comparator.

6. The liquid crystal display of claim 5, wherein the common voltage generator further comprises a negative feedback inverting amplifier including an inverting terminal receiving a feedback voltage for the common voltage applied to the pixels via a resistor and a non-inverting terminal receiving the at least one common voltage.

7. The liquid crystal display of claim 5, wherein the comparator comprises a look-up table storing the adjusting value for the compared result.

8. The liquid crystal display of claim 5, wherein the reference voltage generator include a plurality of resistors.

9. The liquid crystal display of claim 5, wherein the reference gray is a middle gray.

* * * * *